US012623699B2

(12) United States Patent
Czerwiński et al.

(10) Patent No.: US 12,623,699 B2
(45) Date of Patent: May 12, 2026

(54) COUPLER FOR A RAIL VEHICLE AND RAIL VEHICLE WITH A COUPLER

(71) Applicant: Dellner Couplers AB, Falun (SE)

(72) Inventors: Tomasz Czerwiński, Chwaszczyno (PL); Abdelkader Ahmed Chawki Saffih, Haguenau (FR)

(73) Assignee: Dellner Couplers AB, Falun (SE)

( * ) Notice: Subject to any disclaimer, the term of this patent is extended or adjusted under 35 U.S.C. 154(b) by 653 days.

(21) Appl. No.: 18/076,973

(22) Filed: Dec. 7, 2022

(65) Prior Publication Data

US 2023/0202537 A1 Jun. 29, 2023

(30) Foreign Application Priority Data

Dec. 8, 2021 (EP) ..... 21213243

(51) Int. Cl.
*B61G 7/08* (2006.01)

(52) U.S. Cl.
CPC ..... *B61G 7/08* (2013.01)

(58) Field of Classification Search
CPC ..... B61G 7/08
See application file for complete search history.

(56) References Cited

U.S. PATENT DOCUMENTS 1,920,410 A 8/1933 Rudolf et al.
2,287,954 A 6/1942 Wolfe
(Continued)

FOREIGN PATENT DOCUMENTS

CH 376956 A * 4/1964 ..... B61G 1/36
CN 110072757 A 7/2019
(Continued)

OTHER PUBLICATIONS

European Search Report in EP Application No. 21213243.5 mailed on Jun. 1, 2022, 5 pages.
(Continued)

*Primary Examiner* — Robert J McCarry, Jr.
(74) *Attorney, Agent, or Firm* — Howard IP Law Group, PC

(57) ABSTRACT

A coupler for a rail vehicle comprising: a front portion having a forward end and a rear end, and a coupler head arranged on the forward end of the front portion; a rear portion having a forward end and a rear end and extending along a longitudinal axis from the rear end to the forward end, and a pivot anchor arranged on a rear end of the rear portion, the pivot anchor configured to be attached to a car of a rail vehicle, a joint for connecting a rear end of the front portion to the forward end of the rear portion, the joint configured to allow the front portion to pivot in relation to the rear portion about an pivot axis that is perpendicular to the longitudinal axis from an operational position in which the forward portion and the rear portion are aligned so that the forward portion extends in a forward direction from the rear portion, to a pivoted position in which the forward portion is pivoted about the pivot axis so that the forward portion extends at an angle from the rear portion, wherein the coupler further comprises a crash plate attached to the forward end of the rear portion by way of a crash plate joint, the crash plate joint configured to allow the crash plate to pivot in relation to the rear portion about an pivot axis from an operational position in which the crash plate is arranged in front of the rear portion to a pivoted position in which the crash plate is pivoted about the pivot axis to a side position.

16 Claims, 7 Drawing Sheets

(56) References Cited

U.S. PATENT DOCUMENTS

| | | | |
|---|---|---|---|
| 2,381,603 | A | 8/1945 | Larsson |
| 3,871,529 | A | 3/1975 | Dial et al. |
| 8,960,464 | B2 | 2/2015 | Peckham |
| 9,758,182 | B2 | 9/2017 | Peckham et al. |
| 10,518,789 | B2 | 12/2019 | Zhao et al. |
| 2007/0186802 | A1 | 8/2007 | Gough |
| 2019/0300027 | A1 | 10/2019 | Kolshorn et al. |
| 2021/0345535 | A1 | 11/2021 | Manica et al. |
| 2023/0202537 | A1 | 6/2023 | Czerwinski et al. |
| 2023/0211814 | A1 | 7/2023 | Skowronek et al. |
| 2023/0211815 | A1 | 7/2023 | Skowronek et al. |
| 2023/0406371 | A1 | 12/2023 | Kinghorn |
| 2025/0162623 | A1 | 5/2025 | Gylling |

FOREIGN PATENT DOCUMENTS

| | | | | |
|---|---|---|---|---|
| CN | 210391159 | U | 4/2020 | |
| CN | 212047325 | U | 12/2020 | |
| DE | 4006811 | A1 | 9/1991 | |
| DE | 19921510 | A1 | 11/2000 | |
| EP | 1112909 | A1 | 7/2001 | |
| JP | H0245263 | A | 2/1990 | |
| WO | 2008132124 | A1 | 11/2008 | |
| WO | WO-2020140646 | A1 * | 7/2020 | ..... B61G 7/08 |

OTHER PUBLICATIONS

Extended European Search Report in EP Application No. 20211246.2, dated May 11, 2021; 8 pages.

Extended European Search Report in EP Application No. 20211248.8, dated May 10, 2021; 9 pages.

Extended European Search Report in EP Application No. 20178784.3, dated Apr. 28, 2021; 13 pages.

International Search Report and Written Opinion in PCT Application No.—PCT/EP2021/065189, mailed on Oct. 1, 2021; 14 pages.

International Search Report and Written Opinion in PCT Application No.—PCT/EP2021/065186, mailed on Oct. 1, 2021; 14 pages.

* cited by examiner

COUPLER FOR A RAIL VEHICLE AND RAIL VEHICLE WITH A COUPLER

FIELD OF THE INVENTION

The invention pertains to a coupler for a rail vehicle. The invention also pertains to a rail vehicle with a coupler.

SUMMARY

Such coupler comprises:

- a front portion having a forward end and a rear end, and a coupler head arranged on the forward end of the front portion;
- a rear portion having a forward end and a rear end and extending along a longitudinal axis from the rear end to the forward end, and
- a pivot anchor arranged on a rear end of the rear portion, the pivot anchor being configured to be attached to a car of a rail vehicle,
- a joint for connecting a rear end of the front portion to the forward end of the rear portion, the joint being configured to allow the front portion to pivot in relation to the rear portion about an pivot axis that is perpendicular to the longitudinal axis from an operational position in which the forward portion and the rear portion are aligned so that the forward portion extends in a forward direction from the rear portion, to a pivoted position in which the forward portion is pivoted about the pivot axis so that the forward portion extends at an angle from the rear portion.

If the coupler is not in use, it is advantageous that the front portion does not protrude from the front of a rail vehicle to save space and to avoid collision with other parts. In order to retract the coupler and to place it in close proximity to the underframe of the rail vehicle, the front portion is pivotable in relation to the rear portion. However, when the coupler is in the retracted position, a damage of the coupler due to accidental collision with mating couplers might occur. If at least one of the mating couplers is not in a position ready for coupling while the coupling process is running, severe damage might occur to the couplers. For example, the forward portion of one coupler rams the joint of the other coupler and damages or destroys it. A reason for the circumstance that a coupler is not in a position ready for coupling while coupling is carried out might be a malfunction of the coupler not allowing a pivoting of the forward portion in relation to the rear portion. Another reason might be that activating such pivoting has been forgotten by the operator.

Therefore, the problem to be solved is to provide a coupler with a pivotable front portion that is better protected for crash scenarios. This problem is solved by the coupler and rail vehicle according to embodiments of the present disclosure.

The basic idea of the invention is to provide a protective device which is arranged and designed to prevent or reduce damage to the mounting arm (front portion) and/or the coupling arm (rear portion) and/or the joint caused by impact forces. Such a protective device can be a crash plate attached to the forward end of the rear portion by way of a crash plate joint, the crash plate joint being configured to allow the crash plate to pivot in relation to the rear portion about an pivot axis from an operational position in which the crash plate is arranged in front of the rear portion to a pivoted position in which the crash plate is pivoted about the pivot axis to a side position. The crash plate protects the coupler—in particular the front portion, rear portion and the joint—from being damaged by a crash caused by a collision with a mating coupler, when the coupler is not in a position ready for coupling.

In a preferred embodiment, the crash plate has a substantially vertical front surface. In particular, the surface is preferably even. It is advantageous that the surface is substantially perpendicular to the longitudinal axis of the rear portion. The term "substantially perpendicular" also comprise a deviation from 90° of at most 5°, 10° or 20°. Alternatively, the surface might have a different shape, for example a curved one. Also, anti-climbing features may be arranged on the front surface of the crash plate.

The crash plate is arranged in front of the front portion (also designated as forward portion), the rear portion and the joint when the front portion is in the pivoted position. In particular, the crash plate is the part of the coupler protruding at most from the rail vehicle, when the front portion is in the pivoted position. Therewith, the crash plate can act as a protective shield avoiding damage to the front portion, rear portion and the joint.

In a preferred embodiment the rear portion is non-pivotably attached to the pivot anchor. In a preferred embodiment the attachment of the rear portion allows for a first attachment condition, in which the rear portion is non-pivotably attached to the pivot anchor and a second attachment condition, in which the rear portion is pivotably attached to the pivot anchor. This can be provided by a joint and a pin, the joint allowing for the pivotable arrangement and the pin, when inserted into appropriate holes in the parts that would otherwise pivot allowing for a non-pivotable attachment.

In a preferred embodiment the crash plate can be attached to the rear portion by way of a crash plate holder that is mounted on the forward end of the rear portion. Preferably, the crash plate holder and the rear portion are two different parts. This has the advantage that the crash plate holder might be replaced by a new crash plate holder if it was impaired by a collision with a mating coupler. The same applies to the crash plate which in a preferred embodiment might be replaceable together with the holder. A complete reparation or replacement of the whole coupler is not necessary when the damage is limited to these parts. The crash plate holder and the rear portion might be detachably (e.g. by screws) or permanently (e.g. by welding) connected to each other. In an alternatively embodiment the holder might be a part of the rear portion, preferably forming a single piece with the rear portion.

In a preferred embodiment the joint and/or the crash plate joint are parts of the crash plate holder. Preferably the joint has a rear joint portion that is non-pivotably arranged on the rear portion.

The joint can have a pin that is held in the rear joint portion. In a preferred embodiment the joint is rotatably held in the rear joint portion. In a preferred embodiment the front portion is attached to the pin. In a preferred embodiment the front portion is fixedly attached to the pin such that pin and front portion rotate in unison.

The crash plate joint can have a pin that is held in the rear joint portion. In a preferred embodiment the joint is rotatably held in the rear joint portion. In a preferred embodiment the crash plate is attached to the pin. In a preferred embodiment the crash plate is fixedly attached to the pin such that pin and crash plate rotate in unison.

In a preferred embodiment, the joint is arranged on one side of a plane that contains the longitudinal axis of the rear portion and the crash plate joint is arranged on the opposite side of the plane. Preferably the plane is a vertical plane.

The crash plate holder can be permanently fixed to the joint. In an alternative embodiment the crash plate holder is releasably fixed to the joint and/or releasably fixed to the rear portion. The crash plate holder can have sliding rails that cooperate with sliding rails on the rear portion that allow the crash plate holder to be slid onto the rear portion.

In a preferred embodiment the crash plate has an anti-climbing surface. The anti-climbing surface has the function of preventing mating couplers climbing over each other and continuing movement until colliding with parts of the other vehicle. The anti-climbing surface might be for example a surface with a high static friction and sliding friction. Thereby, a relative sliding of mating crash plates being in contact due to a crash is reduced or inhibited; thus the risk of climbing being reduced. Alternatively or additionally, the anti-climbing properties can be established by a stop element.

In a preferred embodiment at least a part of the crash plate comprises a horizontal alignment device for preventing movement in a horizontal direction of a mating coupler.

In the pivoted position, the forward portion is pivoted about the pivot axis so that the forward portion extends at an angle from the rear portion. In a preferred embodiment the angle is less than 90°. This has the advantage that the forward portion is behind a plane involving the crash plate and do not protrude into the half of a mating coupler. This leads to a better protection of the forward portion and also of the mating coupler since the risk of being damaged by a crash with the forward portion is decreased. In a particular preferred embodiment the angle is less than 45°.

In a preferred embodiment the rear portion and/or the pivot anchor comprises an energy dissipating element that will be destructed, if a force of a certain force level is applied to the energy dissipating element. The energy dissipating element might be a deformation tube. Preferably, the deformation tube is a part of the pivot anchor.

In a preferred embodiment the pivot axis of the crash plate joint is parallel to the pivot axis of the joint.

In a preferred embodiment, the pivot movement of the crash plate about the pivot axis of the crash plate joint is synchronized to the pivot movement of the front portion about the pivot axis of the joint. In a preferred embodiment the crash plate joint has a pin with an endsurface, which endsurface is arranged perpendicular to the pivot axis and the joint has a pin with an endsurface, which endsurface is arranged perpendicular to the pivot axis and whereby a bar is provided and one end of the bar attached to the endsurface of the pin of the crash plate joint, whereby the attachment is off center on the endsurface and rotatably and a further end of the bar attached to the endsurface of the pin of joint, whereby the attachment is off center on the endsurface and rotatably.

The rotatable attachment of the end of the bar to the endsurfaces can be provided by a rivet that is attached to the endsurfaces and passes through a hole in the end of the bar. Also a screw with a cylindrical portion might pass through a hole in the end of the bar and may be screwed with its threaded end into the pin.

In a preferred embodiment, the pivot axis dissects the endsurface and the attachment of the end of the bar is provided away from the point where the pivot axis dissects the endsurface hence leading to an attachment off center.

In a preferred embodiment a tube is provided on the back of the crash plate, whereby an end of the tube rests against the forward end of the rear portion when the crash plate is in the operational position.

In a preferred embodiment the crash plate covers the forward end of the rear portion when the crash plate is in the operational state when viewed along the longitudinal axis towards the pivot anchor.

In a preferred embodiment the coupler has a drive, for example a pneumatic or hydraulic cylinder that is attached with one end to the rear portion and attached with its other end to a lever, said lever being connected to the pin of the joint. Expansion or retraction of the cylinder will lead to the end that is attached to the lever and will lead to the lever to rotate about the pivot axis thereby turning the pin of the joint about the pivot axis. This rotation will move the front portion from the operational position to the pivoted position. Given the synchronization of the rotation of the pin with the pin as provided in a preferred embodiment, this rotation will also lead to a rotation of the pin and will lead to the crash plate being moved from the operational position to the pivoted position.

The invention further pertains to a rail vehicle having a coupler according to the invention attached to it.

BRIEF DESCRIPTION OF THE DRAWINGS

Hereinafter, the invention is explained with reference to the following figures, which only show exemplary embodiments of the invention.

DETAILED DESCRIPTION

Figure 1:
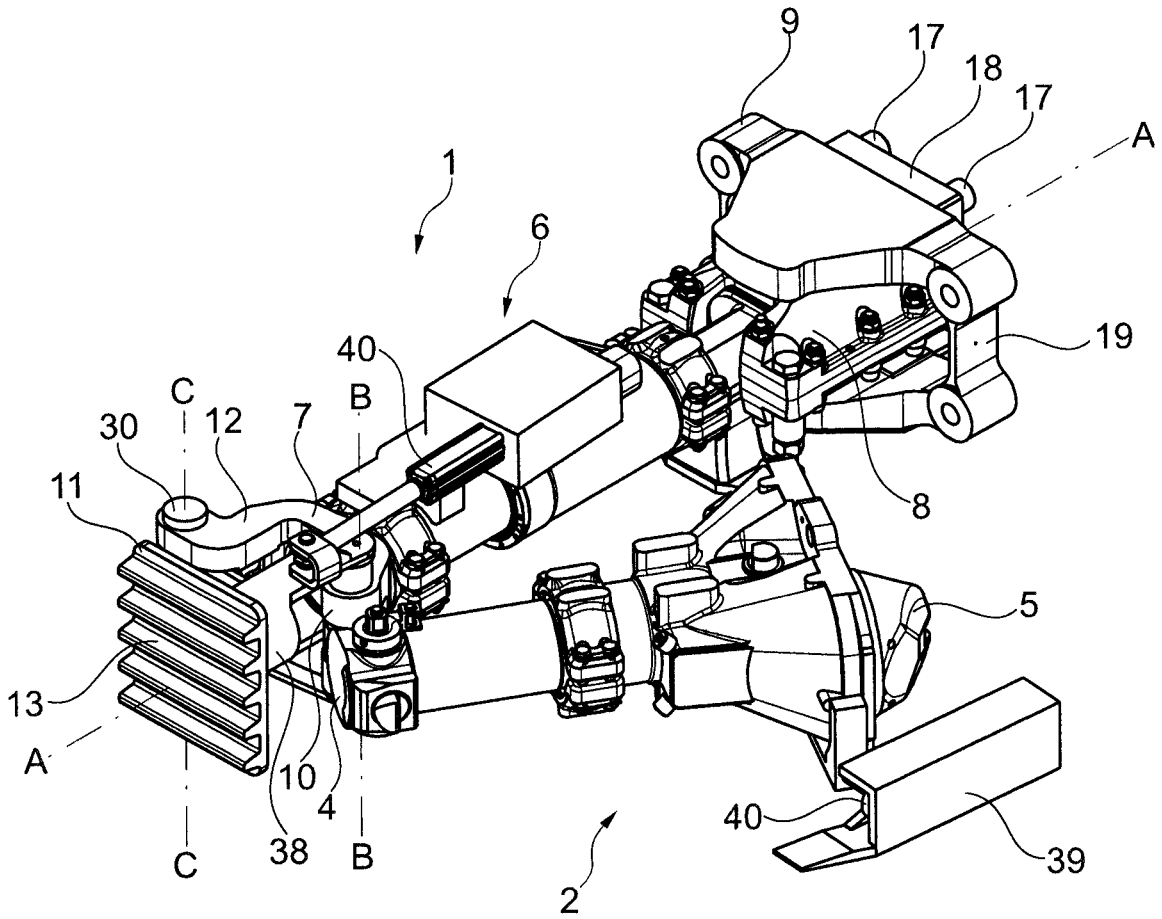
FIG. 1 shows a schematic perspective view of a coupler according to the invention with the front portion in the pivoted position.

FIGS. 1 to 4 shows a schematic perspective view of a coupler 1 according to the invention. The coupler 1 is for a rail vehicle. The coupler 1 will be attached to an end of one rail vehicle. The coupler 1 each comprises a front portion 2 having a forward end 3 and a rear end 4, and a coupler head 5 arranged on the forward end 3 of the front portion 2;

a rear portion 6 having a forward end 7 and a rear end 8 and extending along a longitudinal axis A from the rear end 8 to the forward end 7, and a pivot anchor 9 arranged on a rear end 8 of the rear portion 6, the pivot anchor 9 being configured to be attached to a car of a rail vehicle, a joint 10 for connecting a rear end 4 of the front portion 2 to the forward end 7 of the rear portion 6, the joint 10 being configured to allow the front portion 2 to pivot in relation to the rear portion 6 about an pivot axis B that is perpendicular to the longitudinal axis A from an operational position in which the forward portion 2 and the rear portion 6 are aligned so that the forward portion 2 extends in a forward direction from the rear portion 6, to a pivoted position in which the forward portion 2 is pivoted about the pivot axis B so that the forward portion 2 extends at an angle from the rear portion 6.

The couplers 1 according to the invention further comprise a crash plate 11 attached to the forward end 7 of the rear portion 6 by way of a crash plate joint 30, the crash plate joint 30 being configured to allow the crash plate 11 to pivot in relation to the rear portion 6 about an pivot axis C from an operational position (see e.g. FIG. 1) in which the crash plate 11 is arranged in front of the rear portion 6 to a pivoted position (see e.g. FIG. 2) in which the crash plate 11 is pivoted about the pivot axis C to a side position. The pivot axis C of the crash plate joint 30 is parallel to the pivot axis B of the joint 10, both pivot axis B and pivot axis C are each orientated spaced apart from and perpendicular to the longitudinal axis A.

The pivot movement of the crash plate 11 about the pivot axis C is synchronized to the pivot movement of the front portion 2 about the pivot axis B. The crash plate joint 30 has a pin 31 with an endsurface 32, which endsurface 32 is arranged perpendicular to the pivot axis C and the joint 10 has a pin 33 with an endsurface 34, which endsurface 34 is arranged perpendicular to the pivot axis B and whereby a bar 35 is provided and one end 36 of the bar 35 attached to the endsurface 32 of the pin 31 of the crash plate joint 30, whereby the attachment is off center on the endsurface 32 and rotatably and a further end 37 of the bar 35 attached to the endsurface 34 of the pin 33 of joint 10, whereby the attachment is off centre on the endsurface 34 and rotatably.

A rotation of the pin 33 about the pivot axis B leads to the further end 37 to rotate around the pivot axis B along an arc-shaped path. This movement of the further end 37 will translate into a movement of the end 36, which will rotate around the pivot axis C along an arc-shaped path leading to a rotation of the pin 31 about the pivot axis C. Hence a rotation of the pin 33 can be translated into a rotation of the pin 31.

A tube 38 is provided on the back of the crash plate 11, whereby an end of the tube 38 rests against a crash plate holder 12 when the crash plate 11 is in the operational position.

In the embodiment shown the crash plate 11 is attached to the rear portion 6 by way of a crash plate holder 12 that is mounted on the forward end 7 of the rear portion 6. The joint 10 and the crash plate joint 30 are parts of the crash plate holder 12.

Figure 4:
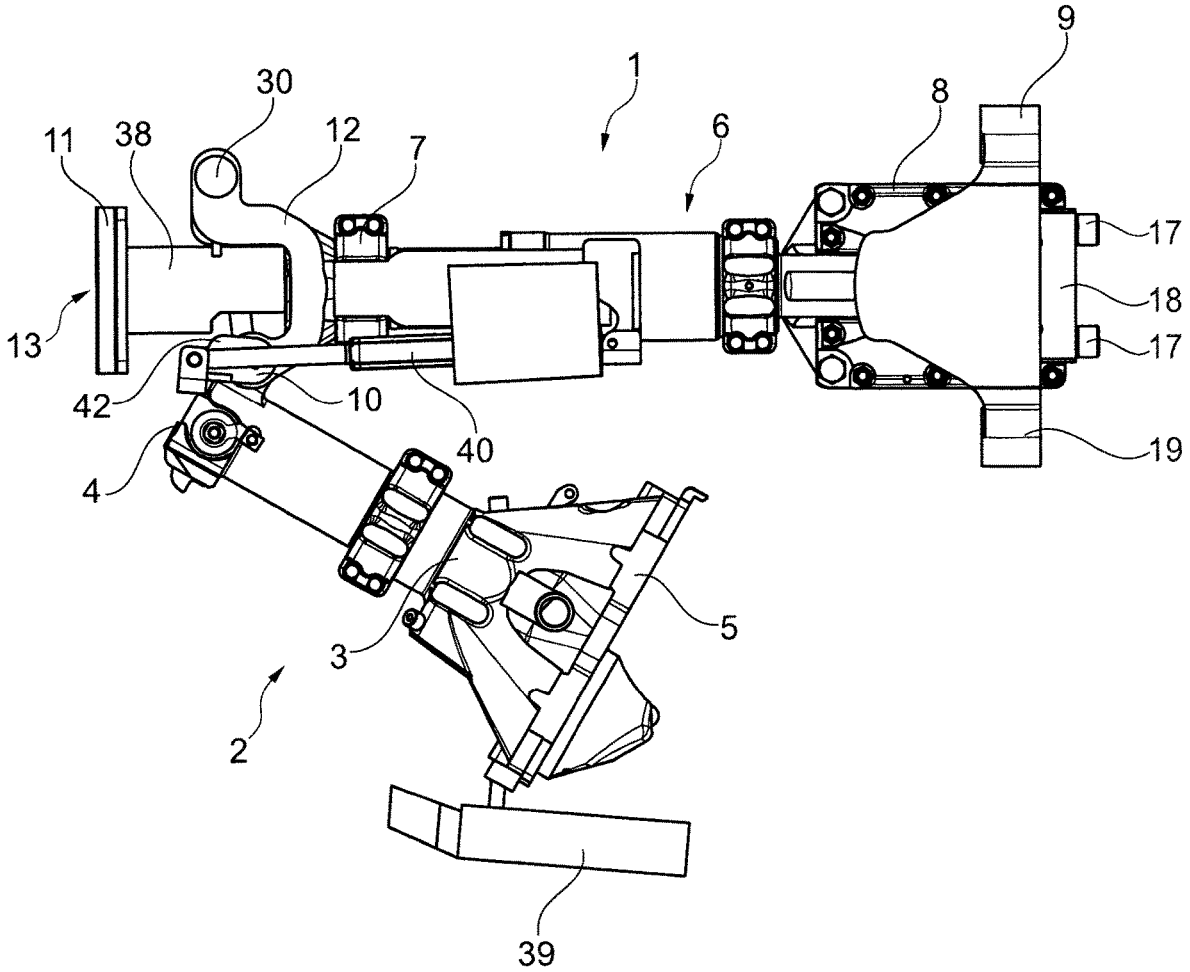
FIG. 4 shows a top view onto the coupler of FIG. 1 with the front portion in the pivoted position.
Figure 5:
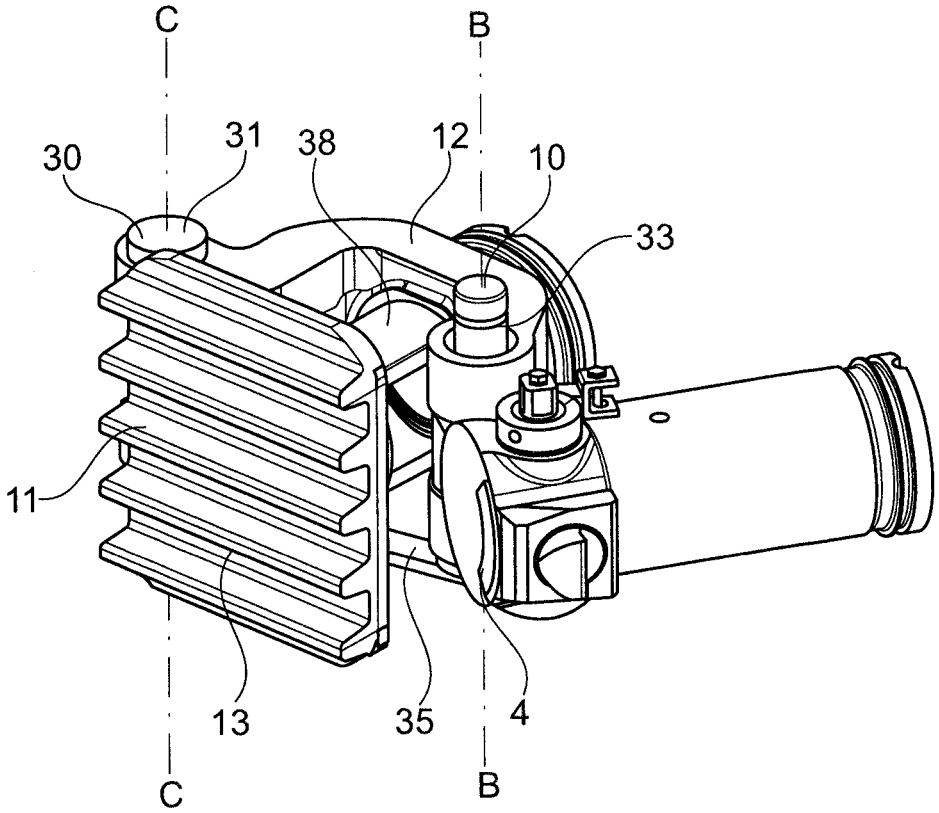
FIG. 5 shows a schematic perspective view onto a crash plate holder and the crash plate and a part of the front portion of the coupler of FIG. 1 with the crash plate in the operational position and the front portion in the pivoted position.
Figure 6:
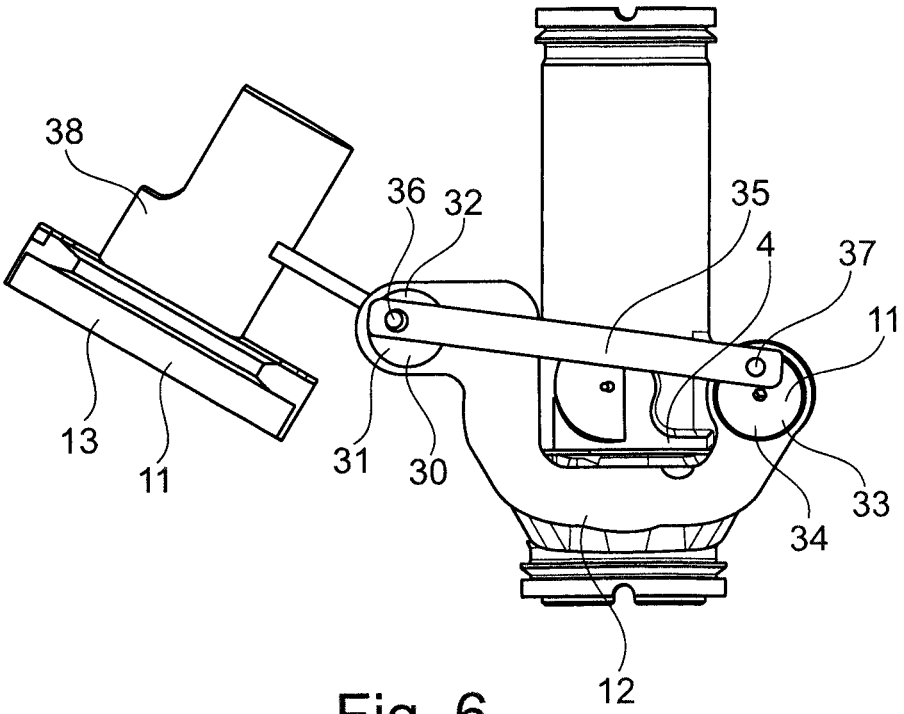
FIG. 6 shows a top view onto the crash plate holder and the crash plate and a part of the front portion of FIG. 5 with the crash plate in the pivoted position and the front portion in the operational position.
Figure 7:
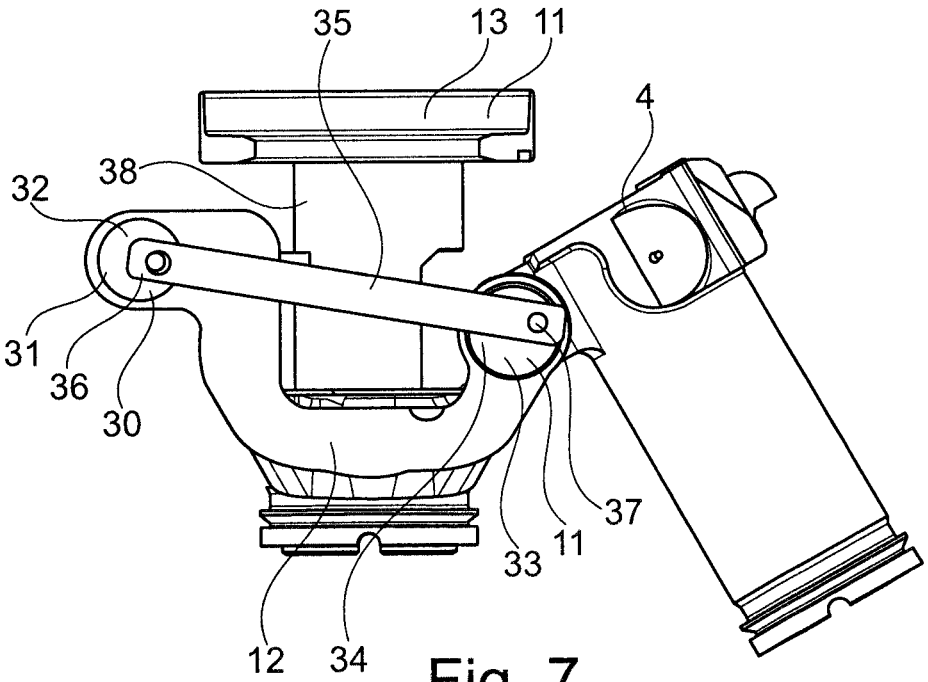
FIG. 7 shows a top view onto the crash plate holder and the crash plate and a part of the front portion of FIG. 5 with the crash plate in the operational position and the front portion in the pivoted position.
Figure 8:
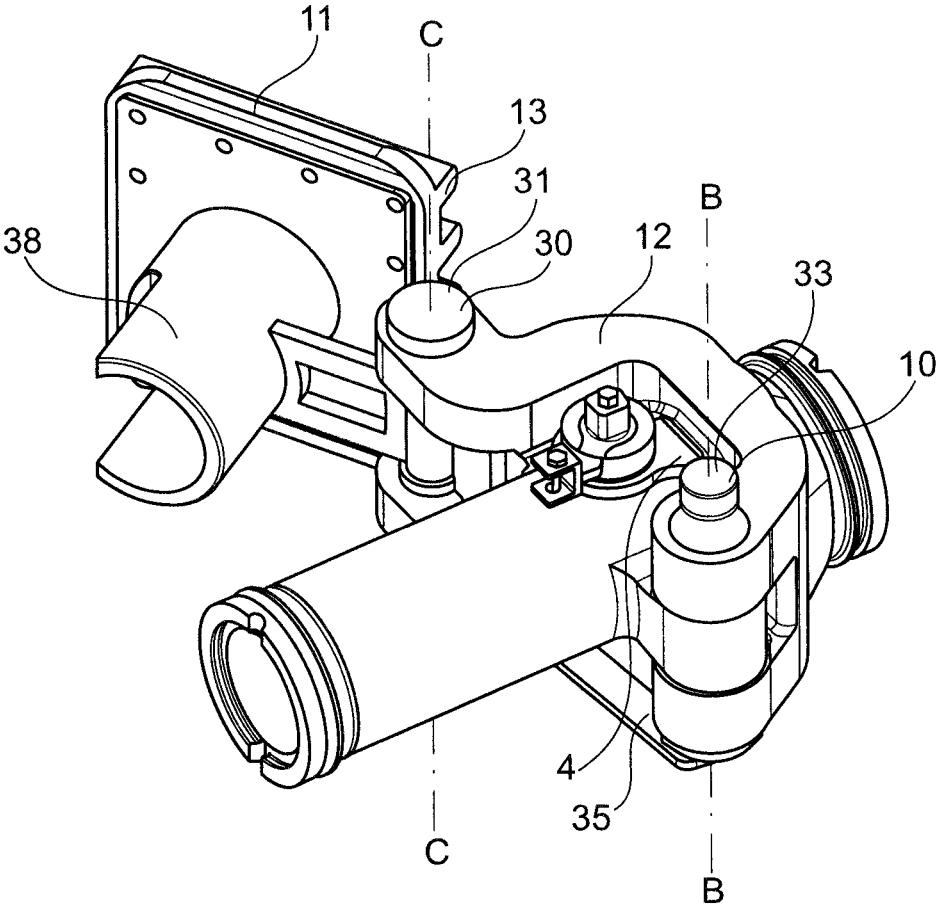
FIG. 8 shows a schematic perspective view onto the crash plate holder and the crash plate and a part of the front portion of FIG. 5 with the crash plate in the pivoted position and the front portion in the operational position.

The crash plate 11 arranged on a crash plate holder 12, said crash plate 11 having a substantially vertical front surface 13 that is arranged in front of the front portion 2, the rear portion 6 and the joint 10 when the front portion 2 is in the pivoted position (see e.g. FIG. 4).

Figure 9:
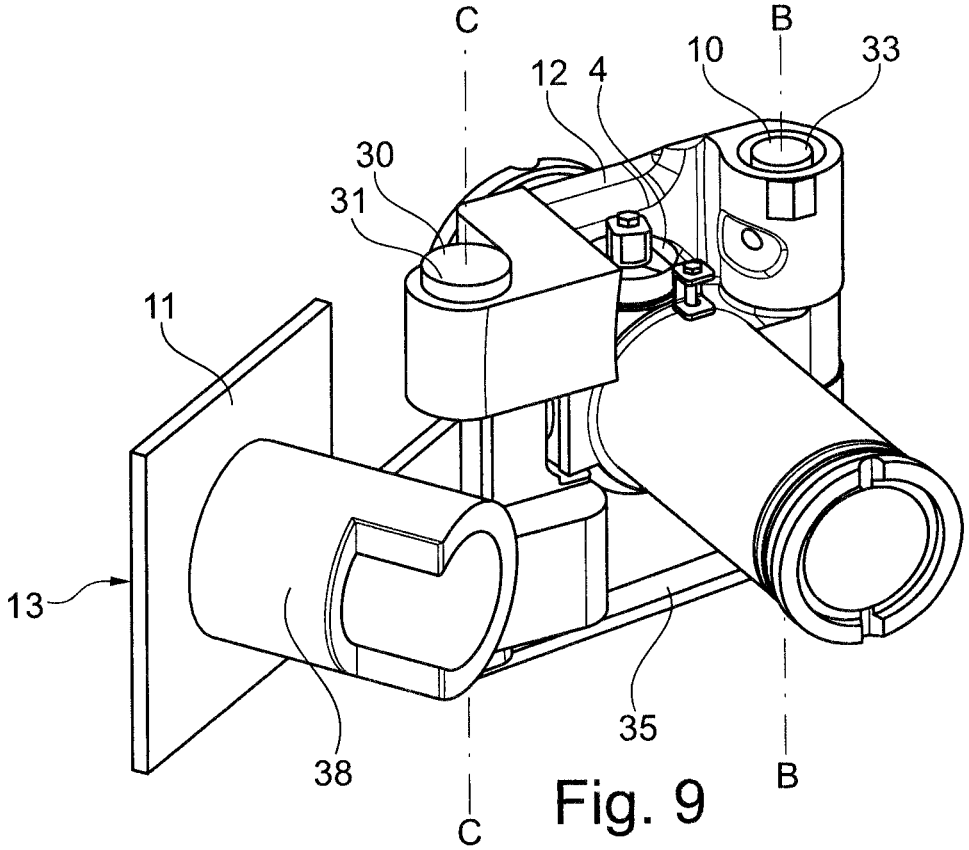
FIG. 9 shows a schematic perspective view onto a crash plate holder and a different crash plate and a part of the front portion of a coupler according to the invention with the crash plate in the pivoted position and the front portion in the operational position.
Figure 10:
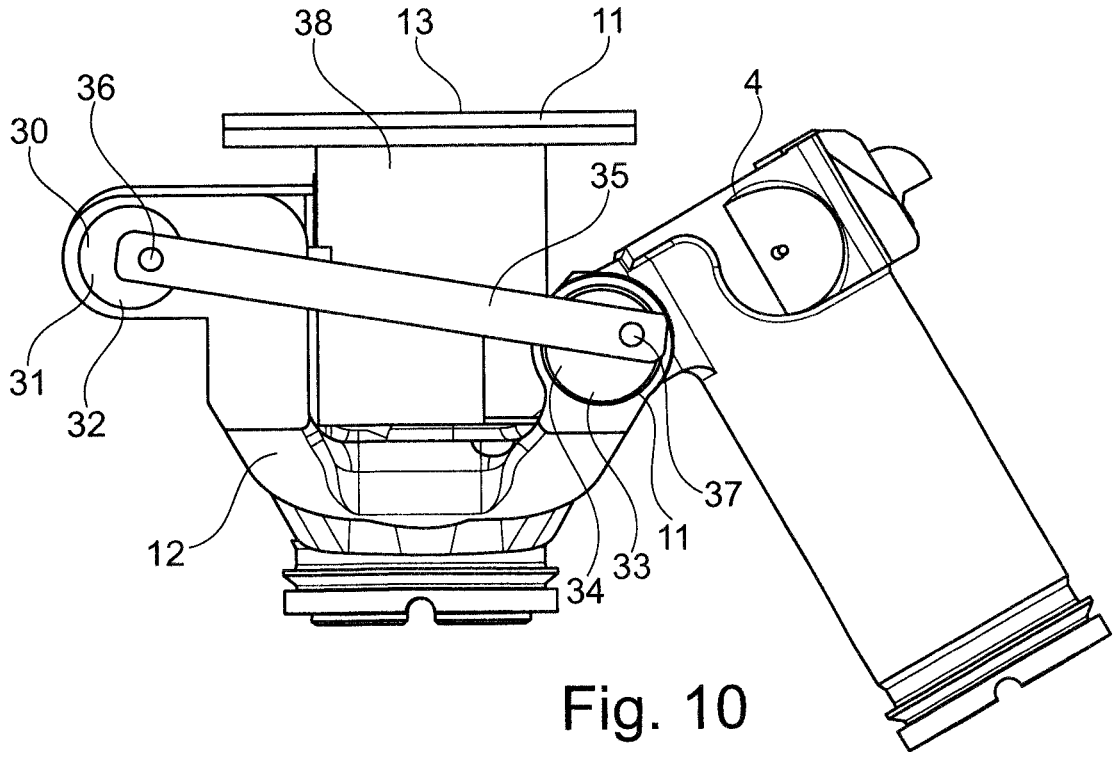
FIG. 10 shows a top view onto the crash plate holder and the crash plate and a part of the front portion of FIG. 9 with the crash plate in the operational position and the front portion in the pivoted position and FIG. 11 shows a schematic perspective view onto the crash plate holder and the crash plate and a part of the front portion of FIG. 9 with the crash plate in the pivoted operational and the front portion in the pivoted position.
Figure 11:
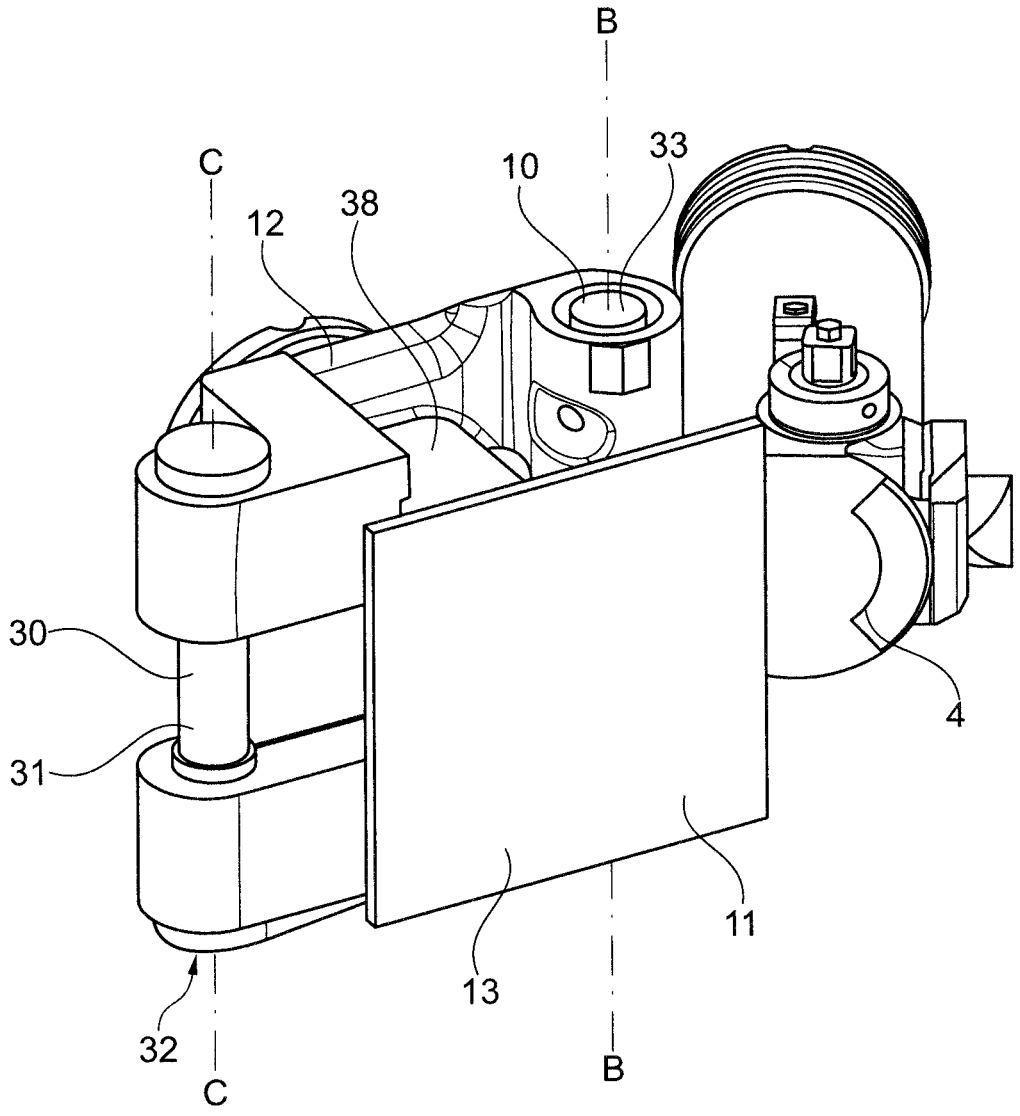

In the embodiment shown in FIGS. 1 to 8, the crash plate 11 has an anti-climbing surface arranged on the vertical front surface 13. In the embodiment shown in FIGS. 9 to 11, the vertical front surface 13 of the crash plate is flat. The angle is less than 90°, preferably less than 45°.

The pivot anchor 9 comprises an energy dissipating element in form of shear out bolts 17. The shear out bolt 17 connects a plate 18 of the pivot anchor 9 with a frame plate 19. The frame plate 19 is intended for being connected to the underframe of a car of a rail vehicle. The shear out bolts 17 will be destructed, if a force of a certain force level is applied to them. Destruction of the shear out bolts 17 also destroys the connection between the plate 18 and the frame plate 19 and sets the frame plate 19 free to move relative to the plate 18.

Figure 2:
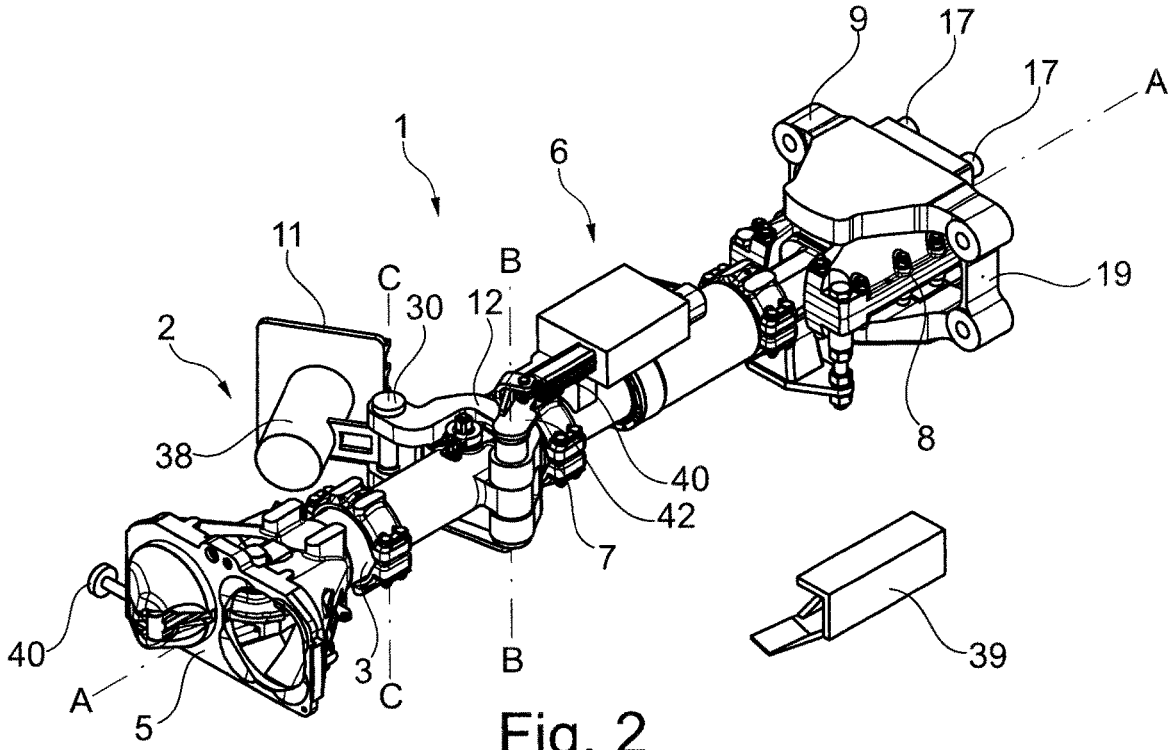
FIG. 2 shows a schematic perspective view of coupler of FIG. 1 with the front portion in the operational position.
Figure 3:
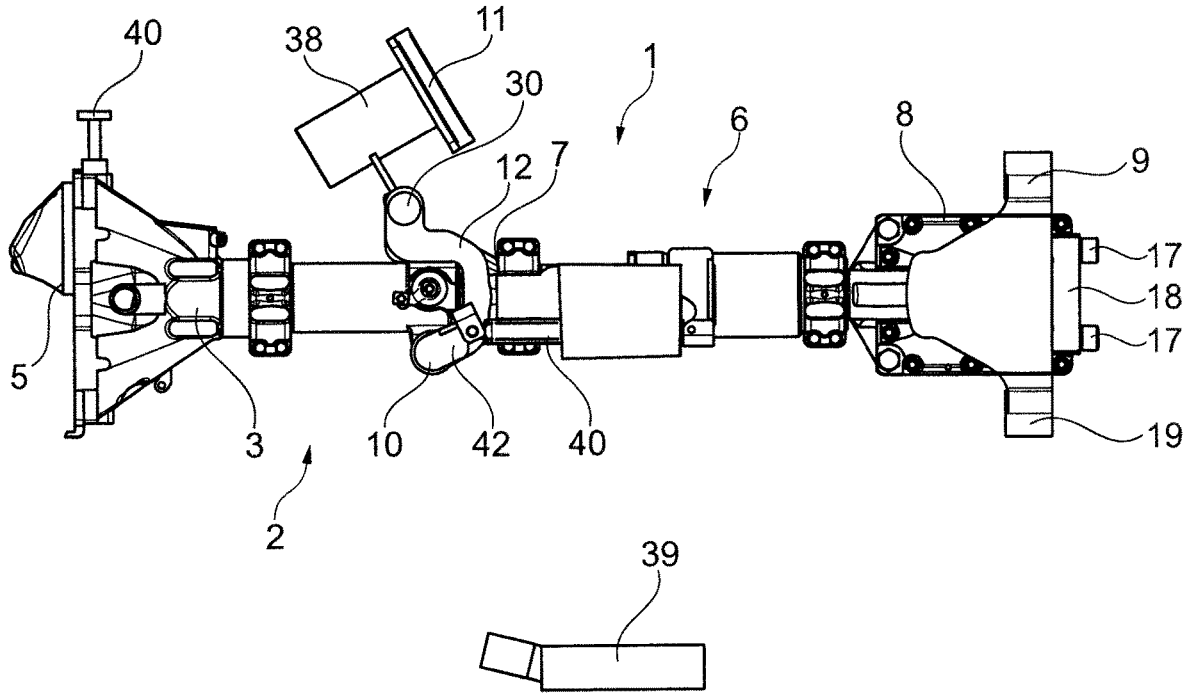
FIG. 3 shows a top view onto the coupler of FIG. 1 with the front portion in the operational position.

FIGS. 1 and 2 show a guide rail 39 that forms part of the underframe of the vehicle.

The front portion 2 can have a guide wheel 40 that is picked up by the guide rail 39 when the front portion 2 is in the pivoted position (see e.g. FIG. 1).

The coupler 1 can have a drive, for example a pneumatic or hydraulic cylinder 41 that is attached with one end to the rear portion 6 and attached with its other end to a lever 42, said lever 42 being connected to the pin 33 of the joint 10. Expansion or retraction of the cylinder 41 will lead to the end that is attached to the lever 42 and will lead to the lever 42 to rotate about the pivot axis B thereby turning the pin 33 of the joint 10 about the pivot axis B. This rotation will move the front portion 2 from the operational position (FIG. 2) to the pivoted position (FIG. 1). Given the synchronization of the rotation of the pin 33 with the pin 31, this rotation will also lead to a rotation of the pin 31 and will lead to the crash plate 11 being moved from the operational position (FIG. 1) to the pivoted position (FIG. 2).

What is claimed is:

1. A coupler for a rail vehicle comprising:

a front portion having a forward end and a rear end;

a coupler head arranged on the forward end of the front portion;

a rear portion having a forward end and a rear end and extending along a longitudinal axis (A) from the rear end to the forward end;

a pivot anchor arranged on a rear end of the rear portion, the pivot anchor configured to be attached to a car of a rail vehicle;

a joint for connecting a rear end of the front portion to the forward end of the rear portion, the joint configured to allow the front portion to pivot in relation to the rear portion about a first pivot axis (B) that is perpendicular to the longitudinal axis (A) from an operational position in which the forward portion and the rear portion are aligned so that the forward portion extends in a forward direction from the rear portion, to a pivoted position in which the forward portion is pivoted about the first pivot axis (B) so that the forward portion extends at an angle from the rear portion;

wherein the coupler further comprises a crash plate attached to the forward end of the rear portion by way of a crash plate joint, the crash plate joint configured to allow the crash plate to pivot in relation to the rear portion about a second pivot axis (C) from an operational position in which the crash plate is arranged in front of the rear portion, to a pivoted position in which the crash plate is pivoted about the second pivot axis (C) to a side position.

2. The coupler according to claim 1, wherein the rear portion is non-pivotably attached to the pivot anchor.

3. The coupler according to claim 1, wherein the second pivot axis (C) of the crash plate joint is parallel to the first pivot axis (B) of the joint.

4. The coupler according to claim 1, wherein the pivot movement of the crash plate about the second pivot axis (C) is synchronized to the pivot movement of the front portion about the first pivot axis (B).

5. The coupler according to claim 4, wherein the crash plate joint has a pin with an endsurface, which endsurface is arranged perpendicular to the second pivot axis (C) and the joint has a pin with an endsurface, which joint pin endsurface is arranged perpendicular to the first pivot axis (B) and wherein a bar is provided, wherein one end of the bar is attached to the endsurface of the pin of the crash plate joint, wherein the attachment is off centre on the crash plate joint pin endsurface and rotatable; and a further end of the bar is attached to the endsurface of the pin of said joint, wherein the attachment is off center on the joint pin endsurface and rotatable.

6. The coupler according to claim 1, further comprising a tube provided on a back of the crash plate, wherein an end of the tube rests against the forward end of the rear portion when the crash plate is in the operational position.

7. The coupler according to claim 1, wherein the crash plate has an anti-climbing surface.

8. The coupler according to claim 1, wherein at least a part of the crash plate comprises a horizontal alignment device for preventing movement in a horizontal direction of a mating coupler.

9. The coupler according to claim 1, wherein the angle is less than 90°.

10. The coupler according to claim 1, wherein the angle is less than 45°.

11. The coupler according to claim 1, wherein the rear portion and/or the pivot anchor comprises an energy dissipating element that will be destructed when a force of a certain force level is applied to the energy dissipating element.

12. A rail vehicle with a coupler comprising:

a car body;

a coupler connected to the car body;

wherein the coupler comprises a front portion having a forward end and a rear end, and a coupler head arranged on the forward end of the front portion;

a rear portion having a forward end and a rear end and extending along a longitudinal axis (A) from the rear end to the forward end; and a pivot anchor arranged on a rear end of the rear portion, the pivot anchor configured to be attached to a car of a rail vehicle;

a joint for connecting a rear end of the front portion to the forward end of the rear portion, the joint configured to allow the front portion to pivot in relation to the rear portion about a first pivot axis (B) that is perpendicular to the longitudinal axis (A) from an operational position in which the forward portion and the rear portion are aligned so that the forward portion extends in a forward direction from the rear portion, to a pivoted position in which the forward portion is pivoted about the first pivot axis (B) so that the forward portion extends at an angle from the rear portion;

wherein the coupler further comprises a crash plate attached to the forward end of the rear portion by way of a crash plate joint, the crash plate joint configured to allow the crash plate to pivot in relation to the rear portion about a second pivot axis (C) from an operational position in which the crash plate is arranged in front of the rear portion, to a pivoted position in which the crash plate is pivoted about the second pivot axis (C) to a side position.

13. The rail vehicle of claim 12, wherein the coupler is connected to an underframe of the car body.

14. The rail vehicle of claim 13, wherein the coupler comprises a frame plate that connects to the underframe.

15. The rail vehicle of claim 14, wherein a guiderail forms part of said underframe.

16. The rail vehicle of claim 15, further comprising a guide wheel that is supported by the guiderail when the front portion is in the pivoted position.

* * * * *